United States Patent [19]

Doo

[11] 3,966,033

[45] June 29, 1976

[54] COIN-CHECK OPERATED ARTICLE LOCK

[76] Inventor: Duncan Doo, 44 Mercer Ave., Englewood, N.J. 07632

[22] Filed: Feb. 20, 1975

[21] Appl. No.: 551,428

[52] U.S. Cl. ..... 194/1 R; 70/58; 194/40

[51] Int. Cl.[2] ..... G07F 5/00

[58] Field of Search ..... 194/32, 40, 48, 54, 194/59, 67, 92, 4 G, 4 E, 45, 49, 51, 55, 74, 65, 1 R; 211/4, 5, 7; 292/181; 70/58, 59, 62, 159, 141

[56] References Cited

UNITED STATES PATENTS

| | | | |
|---|---|---|---|
| 913,188 | 2/1909 | Backus | 70/62 |
| 1,150,923 | 8/1915 | Andrus | 194/67 |
| 1,914,983 | 6/1933 | Saad | 194/59 |
| 3,095,558 | 6/1963 | Crudgington et al. | 194/45 |
| 3,228,506 | 1/1966 | Stackhouse | 194/92 |

*Primary Examiner*—Robert B. Reeves
*Assistant Examiner*—H. Grant Skaggs
*Attorney, Agent, or Firm*—Gardiner, Sixbey, Bradford & Carlson

[57] ABSTRACT

A simple but effective, inexpensive coin-check operated lock is provided for locking articles such as umbrellas, canes, athletic equipment or a rock or stand to prevent theft or unauthorized use thereof and includes a reciprocating sliding bolt locked in extended position by a rocking latching lever which in turn is held in latched position by a coil spring and is unlatched from the bolt by contact of an inserted coin with a swingable spring biased detent arm which cooperates with a check key to hold the latching lever in unlocked position until the coin is inserted at which time the detent arm releases the check and the latching lever which operates to lock the reciprocating bolt in extended position, insertion of the key check unlocks the mechanism and resets same to receive a further coin.

9 Claims, 9 Drawing Figures

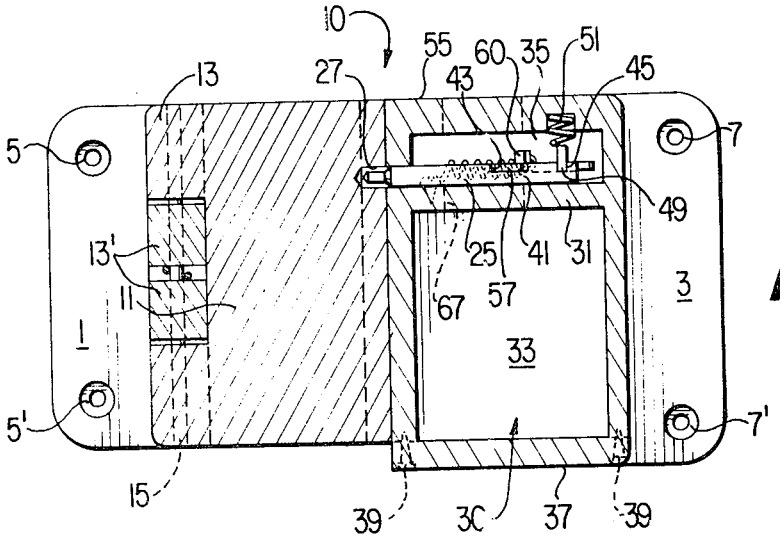
FIG. 4
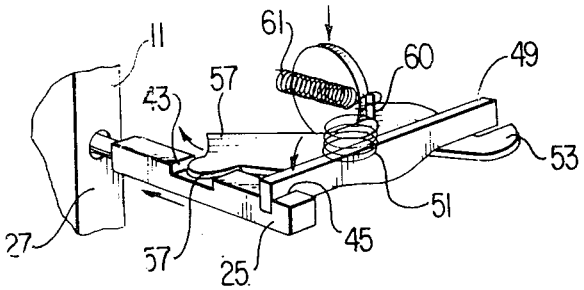
FIG. 5
FIG. 6
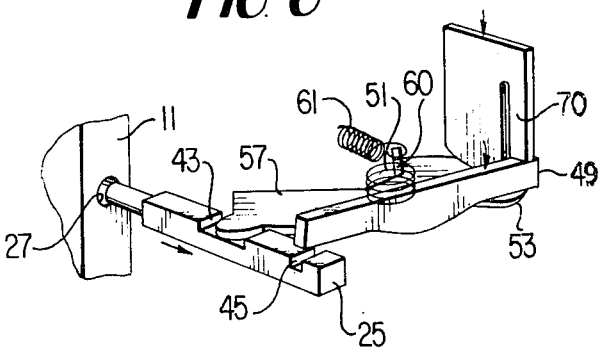
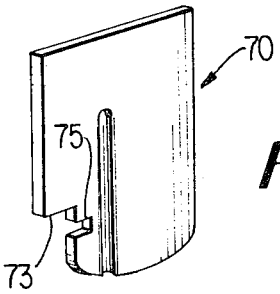
FIG. 7

COIN-CHECK OPERATED ARTICLE LOCK

THE PRIOR ART

Coin, key check operated locking devices are not per se new, examples of such devices are amply illustrated in U.S. Pat. Nos. 3,095,558 and 3,269,506 among others. Such locking devices are used in a variety of ways such as to lock convenience booths in sanitary facilities; locker doors in public places such gymnasiums, transportation stations etc; and hotel doors and the like. In all of these devices a coin is inserted in the lock housing to trigger a mechanism whereby a key operated tumbler member may be actuated to lock position and removed to be retained in the possession of a person until such time as the person desires access to the interior of the lock area. At this point in time the key is re-inserted into the tumbler mechanism and turned to release the mechanism to unlock the device. The key is then non-removeable until another coin is inserted and the whole operation is repeated.

Also known in the prior art are check operated article locked clamping devices for use on racks and stands to hold such articles as umbrellas, hats, coats, canes, athletic clubs and bats and the like to prevent theft and/or unauthorized use. Some examples of such devices may be found in U.S. Pat. Nos. 1,806,660, 1,068,951 and 1,228,631 among others. One of the most successful and widely used of these devices is illustrated in U.S. Pat. No. 1,806,660. Products of this particular type are found in restaurants and similar public facilities throughout the entire country. This particular device does not require a coin deposit and further is subject to several unfortunate deficiencies which can and do result in its being disabled by pranksters who may close the disclosed clamping means by manually actuating the follow up slide shown in the patent and thereafter removing the check so that the device is empty but closed in article clamping position and cannot be opened except with a master or replacement check key.

Finally, as is self evident the noted device is quite complicated structurally and hence comparatively expensive.

OBJECTS OF THE INVENTION

With the prior art in mind, it becomes apparent that one object of the invention is to provide an inexpensive article locking device.

Another object of the invention is to provide a simply manufactured but relatively fool proof locking device.

Still another object of the invention is to provide a coin operated article locking device which will discourage tampering because a coin must be involved and, hence, the user will be inclined to reclaim the locked article and hence return the key check to the proper device.

Many further objects will occur to those skilled in the art but are not specifically delineated here and all may be accomplished by providing, in combination, a housing having an article receiving socket; a pivoted gate for closing the open end of the article receiving socket; a slidably reciprocating bolt for holding the fate closed; a latching lever rockable to two positions for latching and unlatching said slidable bolt means; a coin operated detent defining a bolt operator and key check releasing means and key check means for operating said detent means to reciprocate said reciprocating slidable bolt to gate engaging or gate releasing position and holding said key check means in said housing when said bolt is in gate releasing position.

DETAILED DESCRIPTION

Having described the article locking device in broad terms, its structural and operational details will become readily apparent from consideration of the following detailed description, reference being made to the associated drawings wherein:

FIG. 4, is a plan sectional view taken along the line 4—4 of FIG. 2.

FIG. 5 is a diagramatic view of the operating elements in gate locked condition having responded to coin insertion.

FIG. 6 is a view similar to FIG. 5 but showing the operating elements moved to gate unlock position responsive to insertion of a key check.

FIG. 7, is a perspective view of a key check which is retained by the article owner and subsequently used to unlock the article holder.

Figure 1:
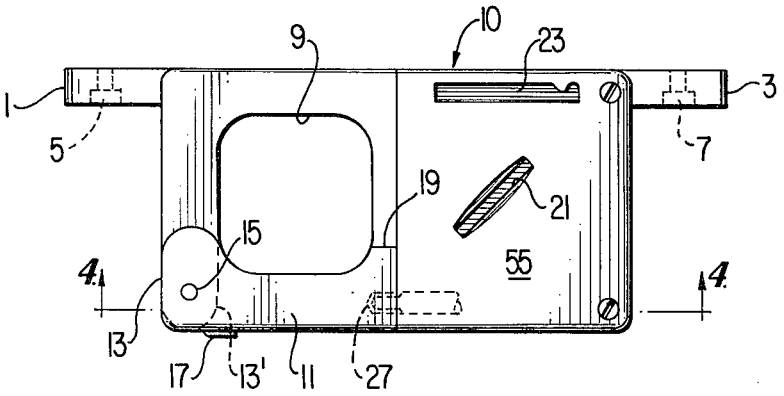
FIG. 1 is a top plan view, certain parts being shown in outline of the article holder defining the invention.
Figure 2:
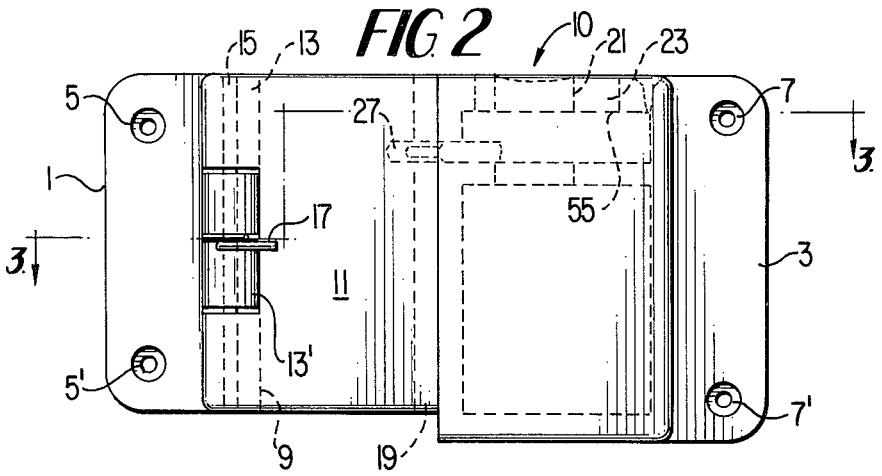
FIG. 2 is a side elevational view, again certain parts being shown in outline, of the device illustrated in FIG. 1.

Considering first FIGS. 1 and 2, the article locking device is shown as comprising a housing 10 provided with laterally outstanding mounting tops 1 and 3. Tabs 1 and 3 are provided with countersink bores 5 and 7 respectively whereby the device may be affixed to an umbrella or cue rack or a wall or any suitable support, not shown, but which, for example, might be a rotatable stand such as shown in U.S. Pat. No. 1,525,330 wherein the top turntable 12 could be easily modified to provide a mount for the locking devices. Preferably the bores 5 and 7 would receive countersink screws having a particular slot configuration, as is well known in the art, which defies removal of the screws by conventional screw drivers or the like tools.

As shown in FIG. 1, in particular, housing 10 is provided with a channel-shaped article receiving slot 9. Extending across the open mouth of the article receiving slot 9 is a pivoted gate 11 conventionally mounted on the housing 10 by the usual hinge pintles 13, 13' and hinge pin 15. The gate 11 which closes the entire open end of article receiving slot 9 is biased to a closed position by means of a spring 17 as is also well known in the art. The free end of gate 11 rests against a vertical land 19 such that, when closed the gate 11 forms a contiguous, smooth outer face with the remainder of the housing to be described. As also shown in FIG. 1 the top surface of housing 10 includes a coin slot 21 and key check slot 23 the function of which will become subsequently apparent.

As also shown in dotted line outline the gate 11 is provided with a horizontal bore 27 which receives a slidable bolt 25, the operation of which will be subsequently described; which bolt inhibits the gate against swinging when an article is positioned in the channel-shaped, article receiving slot 9.

Figure 3:
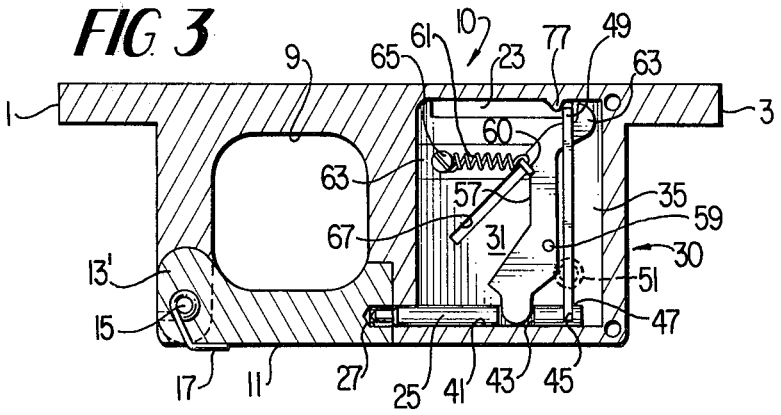
FIG. 3, is an elevational sectional view taken along the line 3—3 of FIG. 1, the bolt in locked position.

Turning now to FIGS. 3 and 4, it may be seen that housing 10 also includes a compartment area 30 which is subdivided by a horizontal partition 31 into upper and lower chambers 33, 35. The lower chamber 33 is a coin depository which receives coins that are deposited in coin slot 21 and pass through upper chamber 33 which may be defined as the operator chamber since it houses the coin operated key check locking mechanism to be subsequently described. Obviously, an access opening is provided to the coin depository which opening is sealed by a lockable cover against pilfering. This arrangement is not shown being obvious to one skilled in the art and because in the prototype device illustrated in the drawings, access may be had through the removable bottom wall 37 held in place by screws 39.

Turning now to FIGS. 3 and 4 in conjunction with FIG. 5., the gate latching and unlatching mechanism comprises an elongated bolt 25 having a generally square or similar cross section which bolt is seated within a grooved or channel 41 provided in the top surface of horizontal partition 31. The bolt has a reduced end adapted to project outwardly into the open end of the article holding channel 9 and into the latching bore 27 provided in gate 11. The upper surface of bolt 25 is provided with two transverse slots or recesses 43 and 45. Recess 43 is located at a point approximately medially of the length of the bolt 25, while slot 45 is located adjacent the end thereof opposite to that end which engages the bore 27 in gate 11.

Rockably mounted in a further slot 47 provided in horizontal partition 31, which slot is perpendicular to slot 41, is a latching lever 49 having one end in contact with bolt 25 and of such thickness as to fit within slot 45 when the bolt is moved to the left or gate engaging position. A small coil spring 51 having its upper end seated in a cylindrical recess 53 in the top cover 55 for operator chamber 35 has its lower end in engagement with the latching lever 49 to bias the lever into contact with the top surface of bolt 25. The opposite or upper end of latching lever 49 as viewed in FIG. 3 extends into the key check slot 23 to be engaged by the key check which will be subsequently described.

Also positioned within the operator chamber 35 is a pivotally mounted, spring biased detent arm 57. This detent arm is pivotally mounted on a pivot pin 59 for rocking motion in a horizontal plane normal to the vertical plane in which latching lever 49 rocks.

As clearly shown in FIG. 3, one end of the detent arm 57 is positioned within the medial slot 43 in bolt 25 so that rocking motion of the detent lever is translated into reciprocating motion of said bolt to gate latching and unlatching positions.

The opposite end of detent arm 57 is connected to a coil spring 61 which tends to rock the detent arm counter-clockwise hence bolt 25 to the gate released position. This same end of the detent arm is also provided with a coin contact abutment 60 which is positioned so as to swing into position with coin slot 21 such that, when the detent lever is in bolt released position, a coin inserted through slot 21 will operate to swing the lever against the bias of spring 61 and rock the detent lever clockwise and slide the bolt 25 to gate latching position. This same end of detent lever 47 is provided also with a laterally extending detent head 63 which is so positioned with respect to the key check slot 23 that it projects across an end of the slot when the detent lever rocks to its bolt release position but is withdrawn from a slot blocking position when the detent lever is rocked to its bolt advancing position as it is shown in FIG. 3. In order to stabilize detent lever and provide a suitable anchor to enable spring 61 to exert a straight line pull thereon, the partition 31 is provided with a raised base 63, see FIG. 3 against which the detent end of lever 61 bears and to which the end of spring 61 is anchored by means of a suitable fastner such as screw 65.

It should also be noted that the horizontal partition 31 is provided with a coin slot 67 which coincides with and is aligned with coin slot 21 in cover 55.

In FIG. 7 a suitable key check is shown which is associated with operation of the article locking device. Basically key checks are well known and consist of a thin flat rigid 70 metal plate of selected dimensions. On one surface of the plate 70 there are provided a variety of grooves, in this case one groove 71 of varying lengths depths and widths which cooperate with the name number of runners, such as runner 75 (see FIG. 3) to permit the key check to be inserted within slot 23. By varying the number and spacing and configuration of the key check grooves and the runners various combinations of key check and locking devices may be generated such that only one coordinated key check will open any one associated article locking device.

Further, plate 70 is so configured as to provide a downwardly facing land 73 along on edge, as shown. Disposed just below the land 73 and extending inwardly is a slot 75. As will become obvious the land 73 and slot are critical to the operation of the subject device.

OPERATION

Considering now FIG. 3 in particular in conjunction with FIGS. 4 and 5 it will be seen that the gate 11 is closed, bolt 25 extended into engagement with the bore 27. This is the operative condition of the device when it is in use and an article is locked in article receiving channel 9, and the key check associated with that particular article holding device has been removed.

To release the article, the person in posession of the key check inserts it into slot 23 with the groove 71 and runner 73 in proper alignment and pushes down on the top thereof. Downwardly facing land 75 engages the end of latching lever 49 and rocks same clockwise as shown in FIG. 5 with the result that the opposite, bolt containing end of the lever lifts out of slot 45 in bolt 25. Bolt 25 is now free to reciprocate and acting under the influence of tension spring 61 the detent lever rocks counter-clockwise with the result that its bolt engaging end in slot 43 of bolt 25 moves the bolt to the right and it is withdrawn from engagement with the keeper bore 27 in gate 11. At the same time, the detent end of detent lever 57 rotates and detent 63 moves into slot 75 in the key check 70 with the result that the key check is locked in the device. Gate 11 is swung open against the bias of spring 17; the article is removed; the gate 11 swings shut and the device is ready to receive a new or another article.

When it is desired to lock another article in the device for safe keeping, the owner will first open gate 11 and insert the article into channel 9. Upon release the gate will be automatically, biased closed again by spring 17. The owner will then insert a coin of the proper size depending on its denomination as fixed by the dimensions of slot 21. As the coin is pushed down toward the underlying slot 67 toward the coin box chamber 37 through the operator chamber 31, its edge engages the coin abutment 60 and wedges it away from its slot blocking position causing the detent lever 47 to rotate or rock in a clockwise direction against the tension of spring 61. As it does the bolt 25 is moved from right to left and its end engages keeper bore 27 in gate 11 due to the action of the lever end in slot 43 therein.

At the same time detent 63 moves out of the slot 75 key check 70 and as it does the bias of coil spring 51 snaps one end of latching 49 lever down into slot 45 as the slot moves into alignment therewith. As the lever rotates counter-clockwise the key check engaging end lifts against land 73 popping the key check up signaling the user that the key check is ready to be and must be removed to securely lock the article in place.

Obviously, when the key check is reinserted into the device the entire operation is repeated.

From the above description it is believed apparent that their is disclosed a very efficient article locking device of the coin key check operated type which is inexpensively made and which utilizes only three moving parts to perform a function which involves a vastly greater number of parts of the prior art devices. It will become apparent too that various modifications and changes based on the disclosed prototype device will occur to those skilled in the art; all of which fall within the perview of the claims wherein.

What is claimed is:

1. A coin check operated article locking device comprising a housing having an article receiving channel therein; a swingable gate moveable to a closed position across the open end of said article receiving channel; reciprocating bolt means moveable toward and away from said gate and engageable therewith to retain the gate in channel closing position; a rockable key check operated latching lever engageable with said bolt to retain same in gate engaging position and moveable to a second position to free said bolt for reciprocating motion away from said gate; a rockable coin operated detent lever having one end in engagement with said bolt at all times whereby rocking of said detent lever is translated into reciprocating motion of said bolt; spring means biasing said detent lever and said latching lever to gate releasing unlatched position.

2. The device as defined in claim 1 wherein said housing is provided with a coin slot and key check slot and wherein one end of said latching lever underlies said key check slot in one position and one end of said rockable detent lever underlies said key check slot in one of its positions.

3. The device as defined in claim 2 including key check means insertable into said key check slot operable to rock said latching lever toward bolt release position and wherein rocking of said detent lever, as said key check means operates to rock said latching lever, locks said key check against removal from said key check slot.

4. The device as defined in claim 3 wherein insertion of a coin into contact with said detent lever releases said key check for removal from said key check slot.

5. The device as defined in claim 4 including coin receipt means for receiving a coin after its contact with said detent lever.

6. The device as defined in claim 1 including spring means biasing said swingable gate toward its closed position.

7. The device as defined in claim 1 wherein said bolt is provided with two upwardly facing slots and one end of each of said detent lever and said latching levers are positioned in engagement with each of said slots when said bolt is in gate engaging position.

8. The device as defined in claim 1 wherein said latching lever is spring biased toward bolt engaging position and said detent lever is spring biased toward bolt retracting position.

9. A coin, key check operated portal locking device comprising a housing, said housing containing a bolt operating mechanism including reciprocating bolt means moveable toward and away from a portal locking to a portal unlocking position; a rockable, key check operated latching lever engageable with said bolt to retain same in portal locking extended position and moveable to a second postion to free said bolt for reciprocating motion to a retracted portal unlocking position, a rockable coin operated detent lever having one end in engagement with said bolt at all times whereby rocking of said detent lever is translated into reciprocating motion of said bolt; spring means biasing said detent lever and said latching lever to portal engaging, latched position when a key check is brought into engagement with said latching lever.

* * * * *